United States Patent [19]

Anderson et al.

[11] 3,973,499

[45] Aug. 10, 1976

[54] SAFE ROCKET MOTOR IGNITER USING SEQUENCED INITIATION TO AN EXPLOSIVE LOGIC NETWORK

[75] Inventors: Matthew E. Anderson, China Lake; Fredric L. Menz, Ridgecrest, both of Calif.

[73] Assignee: The United States of America as represented by the Secretary of the Navy, Washington, D.C.

[22] Filed: Aug. 27, 1974

[21] Appl. No.: 501,101

[52] U.S. Cl. ..... 102/70 R; 102/22; 102/DIG. 2

[51] Int. Cl.[2] ..... F42C 19/08

[58] Field of Search ..... 102/22, 70, DIG. 2

[56] References Cited

UNITED STATES PATENTS

| | | | |
|---|---|---|---|
| 3,392,673 | 7/1968 | King | 102/70 |
| 3,430,564 | 3/1969 | Silvia et al. | 102/DIG. 2 |
| 3,703,865 | 11/1972 | Gilbertson et al. | 102/DIG. 2 |
| 3,753,402 | 8/1973 | Menz et al. | 102/DIG. 2 |
| 3,768,409 | 10/1973 | Menz et al. | 102/DIG. 2 |

*Primary Examiner*—Verlin R. Pendegrass
*Attorney, Agent, or Firm*—R. S. Sciascia; Roy Miller

[57] ABSTRACT

An apparatus for providing ignition of rocket motors by using sequenced initiation to an explosive logic network that is fail safe in case of accidental initiation. The explosive logic network has a multiplicity of input detonators for ignition of the explosive logic in a predetermined time program which must be accomplished in a specific ignition sequence to achieve a single explosive output to ignite the rocket motor squib and fire the motor. A deviation from the predetermined timed sequence or ignition of one or more of the input detonators will dud the system causing a fail safe condition of the logic network that prevents rocket motor ignition.

2 Claims, 3 Drawing Figures

SAFE ROCKET MOTOR IGNITER USING SEQUENCED INITIATION TO AN EXPLOSIVE LOGIC NETWORK

BACKGROUND OF THE INVENTION

1. Field of Invention

This invention relates to a fail safe apparatus for use in initiation of a rocket motor ignitor or of high explosive warheads and more particularly to a device that will not initiate a firing signal even through accidentally triggered by electromagnetic radiation or other environmental effects.

2. Background of Invention

Detonating fuzes have wide utility in many diverse applications where explosives or propellants are used. This is especially true in the aerospace, missile and rocket fields where the use of detonating fuzes require safing techniques that prevent inadvertant firing of a weapon such as a rocket or missile or the arming of a warhead in situations tha could cause damage to the launching source or injury to loading and servicing personnel of the weapon. Many known safe arming devices and techniques used in the safing of warhead detonators are not suitable when applied to the safing of rocket motor igniters. Warhead devices can utilize forces derived from a post launch environment such as boost acceleration caused by rocket motor firing to drive mechanical explosive alignment devices for arming the warhead by establishing an explosive train continuity. These forces are usually not available before missile rocket motor firing.

Prior art attempts to solve the problem of reliable safing of rocket motor igniters has involved the use of mechanical devices such as pulling an alignment rod to align an explosive trail to the igniter whenever the missile is ejected or released from its launching apparatus on an aircraft. Other devices use the dynamic air pressure, caused by aircraft flight above a predetermined threshold velocity, to arm the rocket motor igniter prior to motor firing. These techniques are expensive and in many cases are not suitable for all missiles because of rocket launcher design or missile configuration which may make it unfeasible or impossible to achieve arming by means of movement of mechanical arming devices.

SUMMARY OF THE INVENTION

The apparatus of the invention provides a nonmechanical arming device for a rocket motor or missile igniter that is safe, simple and foolproof in operation.

The device relates to a safing apparatus for a missile that is formed by a pattern of continuous explosive trails fabricated into a logic network on an inert shock absorbing material. The forming of explosive trails into logic and delay networks permits the initiation of a plurality of electrical detonators attached to the explosive trails to cause an initiation of a multiplicity of detonation fronts to propagate along explosive trails forming the network. By electrically actuating each explosive trail detonator in a predetermined time sequence, explosive logic gates are activated to permit the further propagation of a detonation input to the gate only upon prior arrival of a second input to the gate. The explosive gate is formed by branching explosive trails at an acute angle to permit propagation of the detonation wave front onto two paths in addition to utilization of the ability of one explosive path to sever another for interrupting further propagation of the detonation wave front when the two explosive trails intersect at nearly a right angle. The explosive detonation front travels along a uniform explosive trail at a constant velocity thus the time required to travel a longer route will exceed that time required in traveling a shorter route. This characteristic permits the use of a multiplicity of trails formed in a pattern to accomplish certain desired functions.

DESCRIPTION OF THE PREFERRED EMBODIMENT

Figure 1:
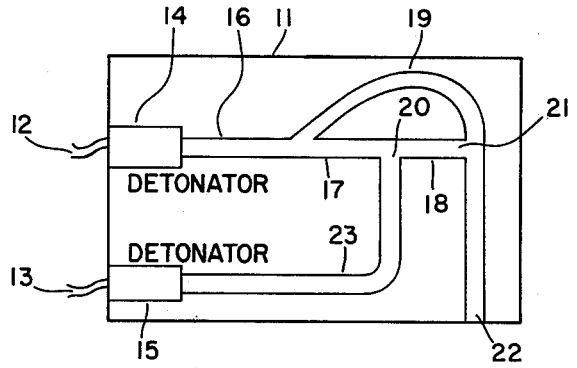
FIG. 1 illustrates an explosive gate of the present invention.

Referring to FIG. 1 in the drawings there is shown a logic gate formed on a plate of shock attenuating material 11. The sinuous paths or trails on plate 11 may be fabricated by forming channels or grooves in the surface of the plate and filling them with an explosive material. Detonators 14 and 15, respectively, initiate the two input signals to the gate. Each of the detonators may be electrically actuated by means of electrical leads 12 and 13 connected to a source of energy, not shown. Detonator 14 is connected to operatively cause an explosive detonating wave front to travel on channel or trail 16 to junction 17. The detonating front splits so as to continue along the curved channel 19, through intersection 21 to output channel 22. The other portion of the detonating front travels via intersection 20 and channel 18 to intersection 21. Detonator 15 initiates a detonating wave front along channel 23 to right angled intersection 20.

The logic gate configuration works because of the "corner effect" which enables the severing of an explosive path by another causing termination of propagation of the detonating front whenever the two paths intersect each other at nearly a right angle. In order to cause a continuance of propagation along two paths from a single path it is necessary to split the single path into two separate paths at some angle less than thirty degrees, such as junction 17 in FIG. 1. A further characteristic of the explosive channels is that the detonation along a thin channel will propagate at a constant speed of approximately one quarter of an inch per microsecond.

Initiation of detonator 14 causes the detonation front to propagate to junction 17 where it splits and continues along both paths toward right angled junction 21. Because the path 19 is longer than the path from junction 17 via junction 20 to right angled junction 21 this detonating front will arrive at junction 21 first. Since intersection 21 is a right angled intersection the path will be severed and will not propagate to output 22. But if the wave front caused by detonator 15 propagates along path 23 and reaches right angled junction 20, before the wave front propagating from detonator 14 the path will be severed at intersection 20 which will allow propagation of a wave front around channel 19 to output 22 via intersection 21.

A circuitry for firing of a rocket motor can be fabricated using the logic gate network 11 of FIG. 1. This circuitry is best shown with reference to FIG. 2 and is fabricated from a plate of shock attenuating material 31 having formed in its surface grooves for explosive trails. It is to be understood that other techniques can be used to form explosive paths such as the use of strips of explosive material or cutting or fabricating a multiplicity of paths from a sheet of explosive material. Detonator 32 may be exploded by means of current through electrical leads 47 from an energy source, not shown. The detonation front propagates along path or trail 37 to output path 42 via a logic gate. A second logic gate having one of its inputs connected to path 42 and its output connected to path 46 allows propagation of the wave front to fire rocket motor 36 by means of squib 35 if a proper sequence of detonator initiations occurs. Detonator 33 which can be initiated by electrical energy to leads 48 starts a detonating wave front that travels along path 41 where it splits into two separate paths, path 38 and path 39, respectively. Each of these paths are sinuous so as to cause a predetermined time lapse before the detonating fronts reach right angled intersections *a* and *b*.

Detonator 34 is also capable of electrical initiation by means of electrical leads 49 which initiate a detonating front along path 44 that splits into two separate paths 43 and 45 which terminate at right angled intersection *c* and *d*, respectively, at predetermined times after initiation.

The use of the circuitry in conjunction with the rocket motor allows a rocket initiating system that contains no out-of-line explosive elements, but uses a predetermined sequence of signals to cause initiation of the rocket motor igniter or squib 35. Accidental firing is prevented because of the very low probability that the exact sequence of signals required for initiation of the squib could be introduced to fire detonators, 47, 48, and 49 by sources such as electromagnetic radiation or other environmental conditions. Further safety could be provided by allowing electrical initiation of the igniters only after an aircraft carrying the missiles is in flight. This could be accomplished by mechanical or electrical sensors such as an air velocity sensor if like devices known to those skilled in this art.

Figure 2:
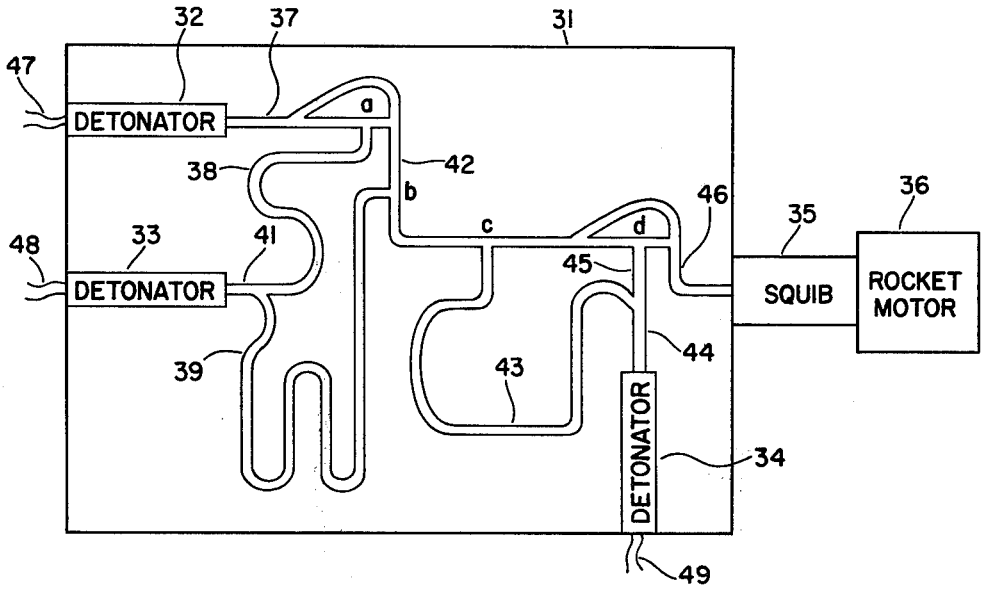
FIG. 2 illustrates a network of explosive trails formed in a configuration for safe ignition of a rocket motor.
Figure 3:
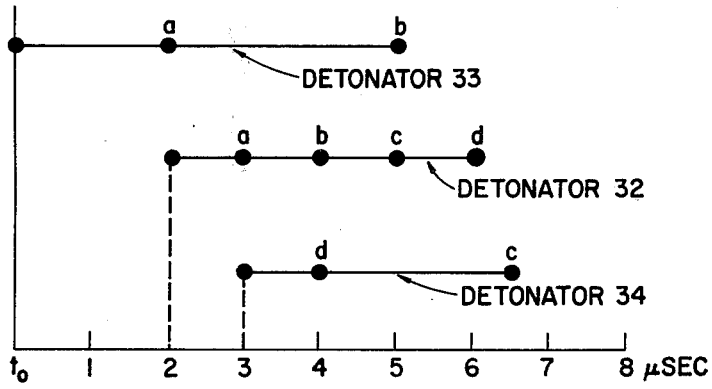
FIG. 3 illustrates a time sequence graph of the initiation sequence in accordance with this invention.

In operation of the system depicted by FIG. 2, detonator 33 is initiated, followed by detonator 32 2 microseconds later, followed by detonator 34 3 microseconds after detonator 33. Reference to FIG. 3 indicates the time and sequence of initiation of each detonator and arrival of the detonating wave fronts at points designated as *a*, *b*, *c*, *d* corresponding to the letters at particular points on the drawing of FIG. 2. The proper time initiation results in both logic gates, best shown with reference to FIG. 2, being open at the proper time by severing the explosive paths at points *a* and *d*. The main path to the rocket motor squib is initiated by detonator 32.

The timing is such that if detonator 33 is initiated at $t_0$, detonator 32 must be initiated at $t_0 + 2$ microseconds, and detonator 34 at $t_0 + 3$ microseconds. A tolerance on the initiation times relative to nominal is plus or minus 1 microsecond. Two microseconds after initiation of detonator 33 at $t_0$, the first explosive logic gate is open at point *a*. The main explosive path 37 initiated by detonator 32 nominally reaches point *a* at 3 microseconds after $t_0$ and will not cut itself, thus allowing propagation to continue to point *b* at $t_0 + 4$ microseconds. The other explosive path 41 initiated by detonator 33 reaches point *b* at $t_0 + 5$ microseconds which is nominally too late to prevent further propagation to the rocket squib 35. If detonator 32 is as much as one microsecond early the gate *a* will still be open in time and if it is 1 microsecond late the main path will still pass point *b* before the path is cut by a detonating front originating from detonator 32. The explosive paths from detonator 34 open the second gate at *d* nominally at time $t_0 + 4$ microseconds and close the main explosive path *c* nominally at time $t_0 + 7$ microseconds.

Consider now detonator 32 being 1 microsecond early and detonator 34 being 1 microsecond late, both times being referenced to time $t_0$. This will still allow the second gate to be open in time at point *d*. If detonator 32 is 1 microsecond early the main explosive path can pass point *c* before it is cut. Thus the required sequence to cause initiation of the squib 35 can be given in table form as follows:

| DETONATOR | TIME (MICROSECONDS) |
|---|---|
| 33 | $t_0$ |
| 32 | $t_0 + 2 \pm 1$ |
| 34 | $t_0 + 3 \pm 1$ |

The above sequence of input firing signals are required at each detonator within the times set out or the system will automatically dud. This permits an increased measure of safety to rocket motors without the use of out-of-line or mechanical firing train interrupters thus, allowing an extremely simple and lightweight unit that is safe from accidental initiation by electromagnetic radiation or other inadvertantly applied environments such as heat, shock, or electric discharge.

Although the preferred embodiment has been described, it will be understood that within the purview of this invention various changes may be made in the form, details, proportion and arrangement of parts, the combination thereof and mode of operation, which generally stated consists in a device capable of carrying out the objects set forth, as disclosed and defined in the appended claims.

What is claimed is:

1. A safing apparatus for use in fail safing a squib used to fire a rocket motor comprising:

a support plate of inert material having first and second continuous uniform explosive trails formed thereon;

first and second electrically actuated igniting means attached to said first and second explosive trails respectively;

said first explosive trail branching at an angle of 30 degrees or less into a curved branch and a straight branch with said curved branch meeting said straight branch in a first right angled junction at their extremities to form a single first output explosive trail;

said second explosive trail branching into a first and second time delay means with said first time delay means meeting at its extremity said first explosive trail straight branch to form a second right angled junction;

said second time delay means having a substantially longer time delay than said first time delay means and meeting at its extremity said first output explosive trail to form a third right angled junction;

transfer charge means attached to said first output explosive trail and to a squib for firing said squib upon the arrival of a detonation wave at said transfer charge;

said safing apparatus operative to provide said detonation wave along said first output explosive trail only when said first and second ignition means are electrically actuated in a predetermined time sequence.

2. The safing apparatus of claim 1, and further including a third continuous uniform explosive trail formed on said support plate, and a third electrically actuated igniting means attached to said third explosive trail, and said first output explosive trail branching into a curved branch and a straight branch with said curved branch meeting said straight branch in a fourth right angled junction to form a single second output explosive trail, and;

said third explosive trail branching into a straight branch and a third time delay means with said third time delay means having substantially longer length than said straight branch and meeting at its extremity said first output explosive trail to form a fifth right angled junction and said third explosive trail straight branch meeting at its extremity said first output explosive trail straight branch to form a sixth right angled junction and said transfer change means attached to said second output explosive trail, and said safing apparatus operative to provide said detonation wave along said second output explosive trail only when said first, second and third igniting means are electrically actuated in a predetermined time sequence.

* * * * *